US007243831B2

(12) United States Patent
Ishizawa et al.

(10) Patent No.: US 7,243,831 B2
(45) Date of Patent: Jul. 17, 2007

(54) FASTENER DRIVING TOOL

(75) Inventors: Yoshinori Ishizawa, Ibaraki (JP); Hiroki Kitagawa, Ibaraki (JP); Masashi Nishida, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/180,544

(22) Filed: Jul. 14, 2005

(65) Prior Publication Data

US 2006/0011694 A1 Jan. 19, 2006

(30) Foreign Application Priority Data

Jul. 15, 2004 (JP) ..... P2004-209197

(51) Int. Cl.
*B25C 1/04* (2006.01)

(52) U.S. Cl. ..... 227/119; 227/120; 227/109; 227/111; 227/130; 227/136

(58) Field of Classification Search ..... 227/120, 227/109, 111, 119, 130, 136
See application file for complete search history.

(56) References Cited

U.S. PATENT DOCUMENTS 4,463,888 A * 8/1984 Geist et al. ..... 227/109
4,767,045 A * 8/1988 Goldshtein et al. ..... 227/109
4,832,245 A * 5/1989 Terayama et al. ..... 227/130
5,131,579 A * 7/1992 Okushima et al. ..... 227/8
5,803,338 A * 9/1998 Singer et al. ..... 227/8
6,592,016 B2 * 7/2003 Hamano et al. ..... 227/119
6,622,901 B2 * 9/2003 Hamano et al. ..... 227/119
6,641,021 B2 * 11/2003 Jablonski ..... 227/120
6,641,022 B2 * 11/2003 Hamano et al. ..... 227/120
6,644,531 B2 * 11/2003 Yamamoto et al. ..... 227/120

FOREIGN PATENT DOCUMENTS

JP 63-174881 7/1988
JP 2001-54880 2/2001

* cited by examiner

*Primary Examiner*—John Sipos
*Assistant Examiner*—Michell Lopez
(74) *Attorney, Agent, or Firm*—Mattingly, Stanger, Malur & Brundidge, P.C.

(57) ABSTRACT

A fastener driving tool includes: a driver blade adapted to drive nails joined to one another into an object in order; a nose adapted to guide the driver blade and nails; and a guide surface of a projection adapted to guide a head portion of a first nail struck out into an exit hole of the nose so that the second nail is not exposed to the exit hole. The guide surface of the projection is formed to a shape identical with that of the head portions of the nails.

20 Claims, 9 Drawing Sheets

FASTENER DRIVING TOOL

BACKGROUND OF THE INVENTION

1. Field of the Invention

The present invention relates to a fastener driving tool provided with an improved nail head guide surface of an exit port from which nails are struck out.

2. Background Art

A related art fastener driving tool will be described by using FIGS. 6 to 10.

The loading of nails 2, which are joined together substantially in parallel with one another at equal intervals by a connecting member made of paper, a plastic material and the like, into a magazine is done from a nail loading port opened in a rear end wall of the magazine 3.

The shape of a cross section of the magazine 3 taken in the direction which is at right angles to the direction in which the nail 2 is supplied is as shown in FIG. 6, so as to retain the nail 2.

In an upper portion of FIG. 6, an upper side of a nail head 2*a* is held on an upper surface 5*a* of a guide groove 5. In a lower portion of the same drawing, a lower side of the nail head 2*b* is held on both sides of a lower surface 5*b* of the guide groove 5. In a lateral direction of the nail 2, an upper portion of the nail 2 is held on guides 6 immediately under the lower surface 5*b*, while a shank portion of the nail 2 is held on guides 7 provided in a substantially central portion of the magazine 3.

The magazine 3 is provided at two vertically spaced portions thereof with guide walls 42 adapted to guide a nail feed mechanism 8 so that the nail feed mechanism 8 is moved slidingly toward an exit portion 9. The nail feed mechanism 8 includes a feeder spring 12 having a rotary shaft 11, which extends in the direction which is at right angles to the shank 2*b* of the nail 2, so as to press the nail 2 toward the exit portion 9, and a nail feeder 14 adapted to press the nail 2 directly, and be turned around a rotary shaft 13 from the guide groove 5 by the loaded nail 2 when the nail feed mechanism 8 is drawn up backward toward the nail loading port 4 after the nail 2 is loaded onto the magazine 3 from the nail loading port 4 at a rear end of the magazine 3, and project into the guide groove 5 by a pressing force of a spring 43 when the nail feed mechanism gets over the nail 2.

The magazine 3 is extrusion molded out of a light non-ferrous metal, such as aluminum and magnesium. Since both sides of the guide groove 5 through which a nail head 2*a* passes are readily worm out, an iron rail 15 is inserted in an inner side of the magazine 3.

In a nose 16, a flat guide surface 10 for guiding a head 17*a* of a first nail 17 is provided, and this guide surface 10 is made of a gentle, inclined surface 20 and joined to an inner circumference of an exit port 19 so as to allow the head 17*a* of the first nail 17 to enter the exit port 19 while the mentioned nail head 17*a* is struck into a wooden material 18. The guide surface 10 is provided so as to determine a position of the first nail 17, i.e. a second nail 21 so that the second nail 21 is not struck by a lower end surface 22*a* of a driver blade 22. When the second nail 21 should also be struck, both the first nail 27 and second nail 21 are struck, so that the nails cannot be struck out from the exit port 19 since a diameter of the exit port is equal to that of one nail, consequently, there is the possibility that the exit port is clogged with the two nails.

The exit port 19 is formed to such a minimum size within the scope of the specifications that permits a nail head 2*a* of a maximum diameter to enter the same so that the nail 2 is rarely bent and buckled due to a load imparted thereto when the nail is struck into the wooden material 18.

A cross section of the driver blade 22 has a maximum substantially recessed shape capable of being moved slidingly in the exit port 19 which shunts the guide surface 10 so as to prevent the bending and buckling of the driver blade 22 and the abrasion of the free end surfaces 22*a*. There is a driver blade the free end surfaces 22*a* of which are chamfered gently and additionally within the scope of the specification so that two nails even having nail heads 2*a* of a small diameter are not struck at a time.

A nail striking operation carried out by the fastener driving tool 1 of the above-mentioned structure will be described with reference to FIGS. 6 to 8. The compressed air supplied to the fastener driving tool by connecting an air hose (not shown) to a body of the fastener driving tool 1 is stored in a pressure accumulation chamber 24.

When a trigger valve 27 is turned on by carrying out both the drawing of a trigger 25 and the applying of a push lever 26 to the wooden material 18, a main valve 28 is moved toward an upper dead center, the pressure accumulation chamber 24 and an upper side of a piston 30 in the cylinder 29 communicate with each other, and the pressure accumulation chamber 24 and an air passage 31 are shut off from each other. The piston 30 is moved quickly toward a lower dead point by the compressed air flowing from the pressure accumulation chamber 24 into the upper side of the piston 30 in the cylinder 29, the nail 2 is struck into the wooden material 18 by the driver blade 22 fixed to the piston 30 in one united body. When the air on the lower side of the piston 30 in the cylinder 29 is returned to a return air chamber 33 via the air passage 32 with the piston 30 passing through an air passage 35 provided with a check valve 34, a part of the compressed air on the upper side of the piston 30 flows into the return air chamber 33 via the air passage 35. The piston 30 contacts a piston bumper 36 in the lower dead center, and the piston bumper 36 is deformed to absorb the excess energy of the piston 30. When the trigger valve 27 is turned off by returning the trigger 25 or by stopping the applying of the push lever 26 to the wooden material 18, the main valve 28 is moved toward the lower dead center. The main valve 28 is closed, and the pressure accumulation chamber 24 and the upper side of the piston 30 in the cylinder 29 are shut off from each other, the upper side of the piston 30 in the cylinder 29 and the atmospheric air being communicated with each other by an exhaust valve rubber 37. The lower side of the piston 30 is pressed by the compressed air accumulated in the return air chamber 33, and the piston 30 is moved quickly toward the upper dead center. The compressed air on the upper side of the piston 30 is discharged from an exhaust hole 39 to the atmospheric air via the air passage 31, air passage 31 and an expansion chamber 38, and the fastener driving tool is returned to an initial condition. When this process is carried out repeatedly, the connected nails 2 are struck into the wooden material 18 successively.

A structure for guiding a first nail by a guide surface 10' of another construction will now be shown in FIG. 9 to FIG. 10. A head 17*a* of the first nail 17 is guided in an exit port 19, and a groove 40 for guiding a lower shank end 17*b* of the first nail 17 is provided at the portion of the magazine 3 which is on the opposite side of the exit port 19. The groove 40 is so wide as to permit the shank 17*c* of the nail to be held therein but not so wide as to permit the nail head 17*a* to be held therein.

A cross-section of the driver blade 22' is not of such a recessed shape that shunts the guide surface 10 shown in FIG. 7 but is of a substantially semicircular shape. The diameter of the nail head 2*a* is set slightly smaller than that of the exit port 19. The free end surfaces 22*a'* of the driver blade 22' are provided with chamfered portions 23' larger than those of the structure of FIG. 7 and FIG. 8 so that the free end surfaces 22*a'* do not strike the second nail 21.

[Patent Document 1] JP-A-63-174881

[Patent Document 2] JP-A-2001-54880

In general, the outer circumference of a nail head 2*a* is circular. The guide surface 10 of a nose of a related art fastener driving tool is a flat surface. Therefore, when the nail 2 pressed by the nail feeder 8, the nail head 2*a* impinges upon the guide surface 10 at one point only thereon, so that the guide surface 10 is worn with ease locally. When the abrasion of the guide surface progresses, the nail head 17*a* of the first nail 17 advances into the worn guide surface 10*a*, and the second nail 21 further advances into the exit port 19 as shown in FIG. 8. The second nail 21 then gets over the chamfered portion 23 provided on the driver blade 22 to cause the superposition 41 of the second nail 21 on the chamfered portion 23 to occur. As a result, the free end surfaces 22*a* of the driver blade 22 strike both the first nail and second nail 21 to cause the stoppage of these nails to occur.

In the structure of FIG. 9 to FIG. 10, the wear on the guide surface 10' caused by the contact of the nail head therewith does not have a problem. Since the guide surface 10' does not project into the exit port 19, it is necessary that a large chamfered portion 23' be provided so as to prevent the free end surfaces 22*a* from striking the second nail. As a result, the areas of the free end surfaces become small to cause the driver blade 22' to be damaged due to the wear on and the excessively large surface pressure on the guide surface.

SUMMARY OF THE INVENTION

An object of the present invention is to provide a fastener driving tool capable of improving the durability of the guide surface and maintaining the durability of the free end surfaces of the driver blade by eliminating the drawbacks of a related art fastener driving tool and reducing the local wear on the guide surface ascribed to the contact of the nail head therewith.

To achieve the object, the invention provides a fastener driving tool including: a driver blade adapted to drive nails joined to one another into an object in order; a nose adapted to guide the driver blade and nails; and a guide surface of a projection adapted to guide a head portion of a first nail struck out into an exit hole of the nose so that the second nail is not exposed to the exit hole; wherein the guide surface of the projection is formed to a shape identical with that of the head portions of the nails.

According to the fastener driving tool of such a structure, the local wear on the guide surface due to the contact of the nail head portion with the guide surface can be reduced, this enabling a fastener driving tool capable of improving the durability of the guide surface to be provided.

Preferably, a diameter of the guide surface of the projection is set equal to a maximum diameter of the head portion of the nail to be used, so that the areas of the free end surfaces of the driver blade can be secured, this enabling the durability of the driver blade to be maintained.

BRIEF DESCRIPTION OF THE DRAWINGS

The present invention may be more readily described with reference to the accompanying drawings.

DETAILED DESCRIPTION OF THE PREFERRED EMBODIMENTS

One embodiment of the guide surface 10 of the exit port 19 of the fastener driving tool according to the present invention will be described by using FIG. 1 to FIG. 5.

The diameter of the guide surface 10 in this mode of embodiment is set equal within the scope of the specification to a maximum diameter of a nail head 2*a*. In short, the outer circumferential surface of the nail head 2*a* contacts substantially the whole of the guide surface 10, so that a surface pressure applied to the guide surface 10 becomes small. This enables the local wear on the guide surface to decrease, and the durability of the guide surface 10 to be improved.

Figure 1:
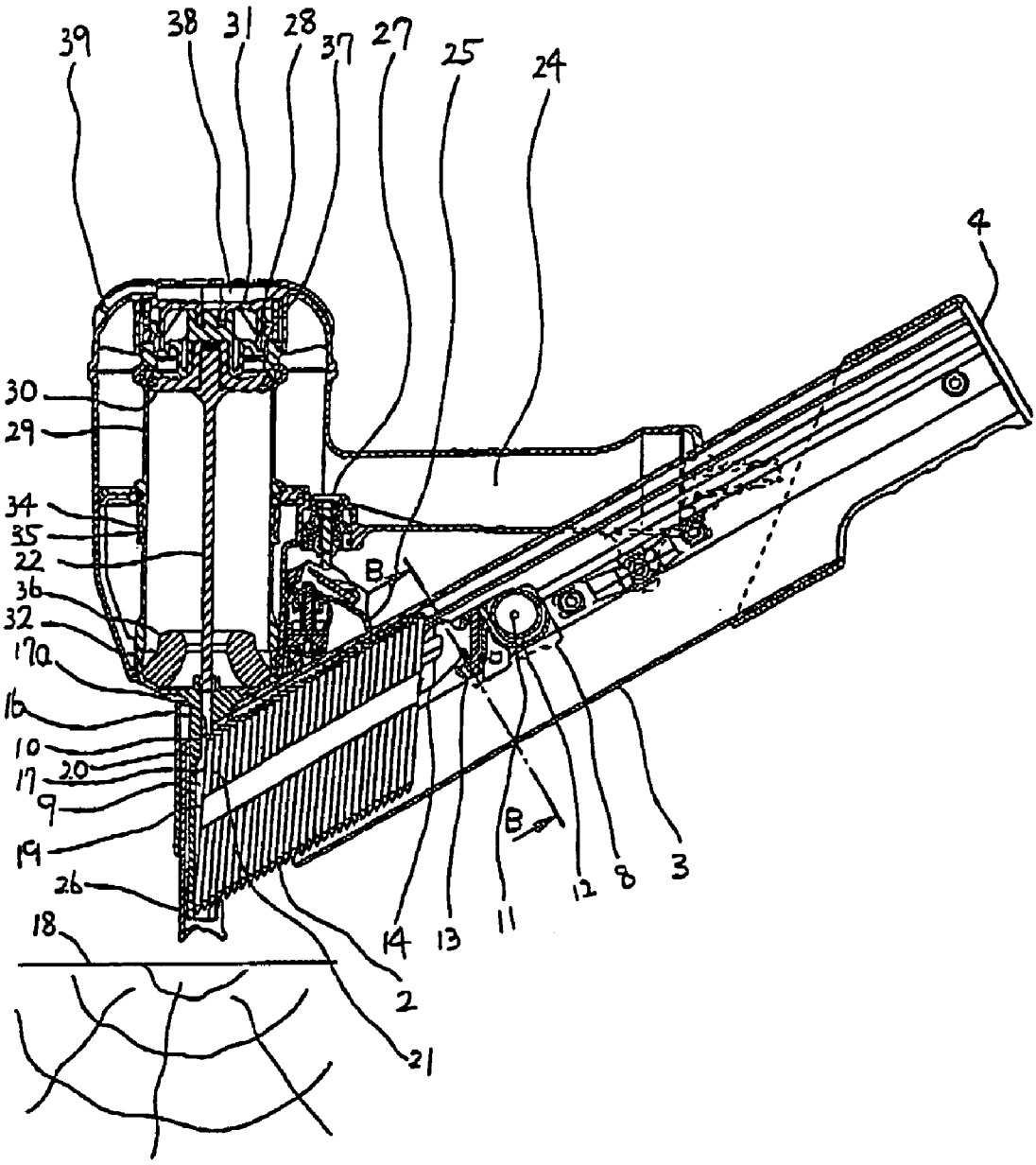
FIG. 1 is a sectional side view showing one example of a fastener driving tool in which the present invention is adaptable.
Figure 2:
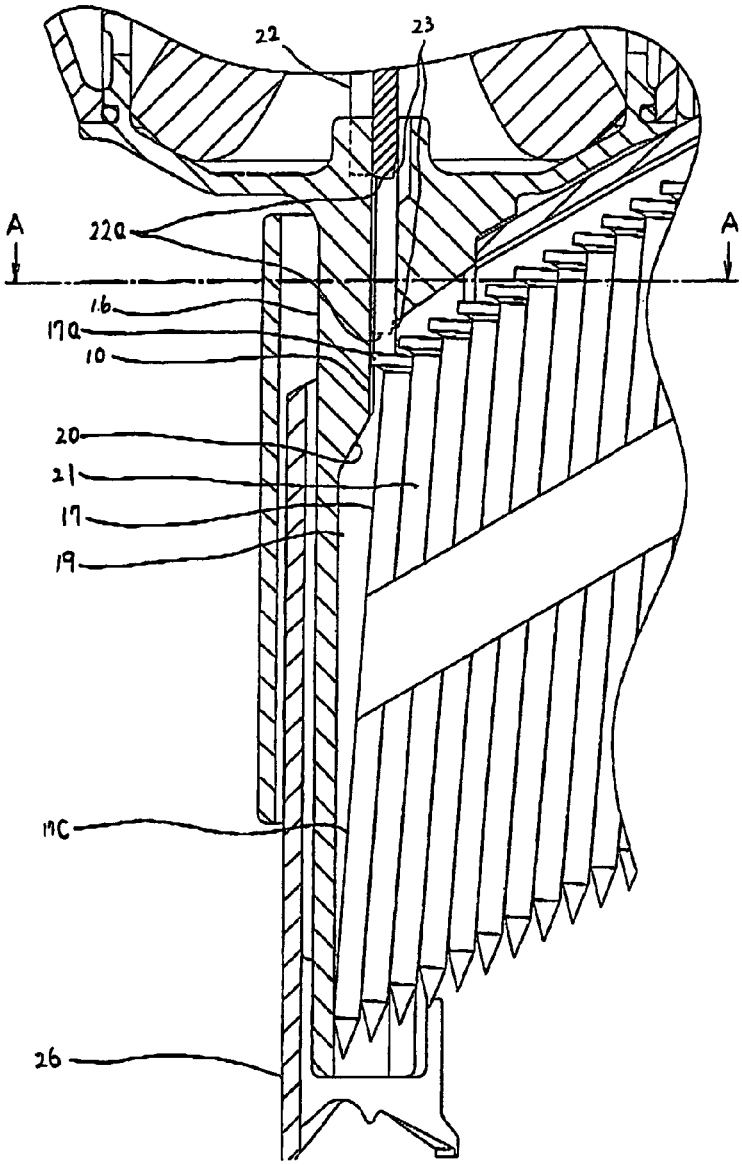
FIG. 2 is a sectional side view showing a principal portion of one embodiment in which a nail of a maximum diameter within the scope of the specifications is struck by the fastener driving tool according to the present invention.
Figure 3:
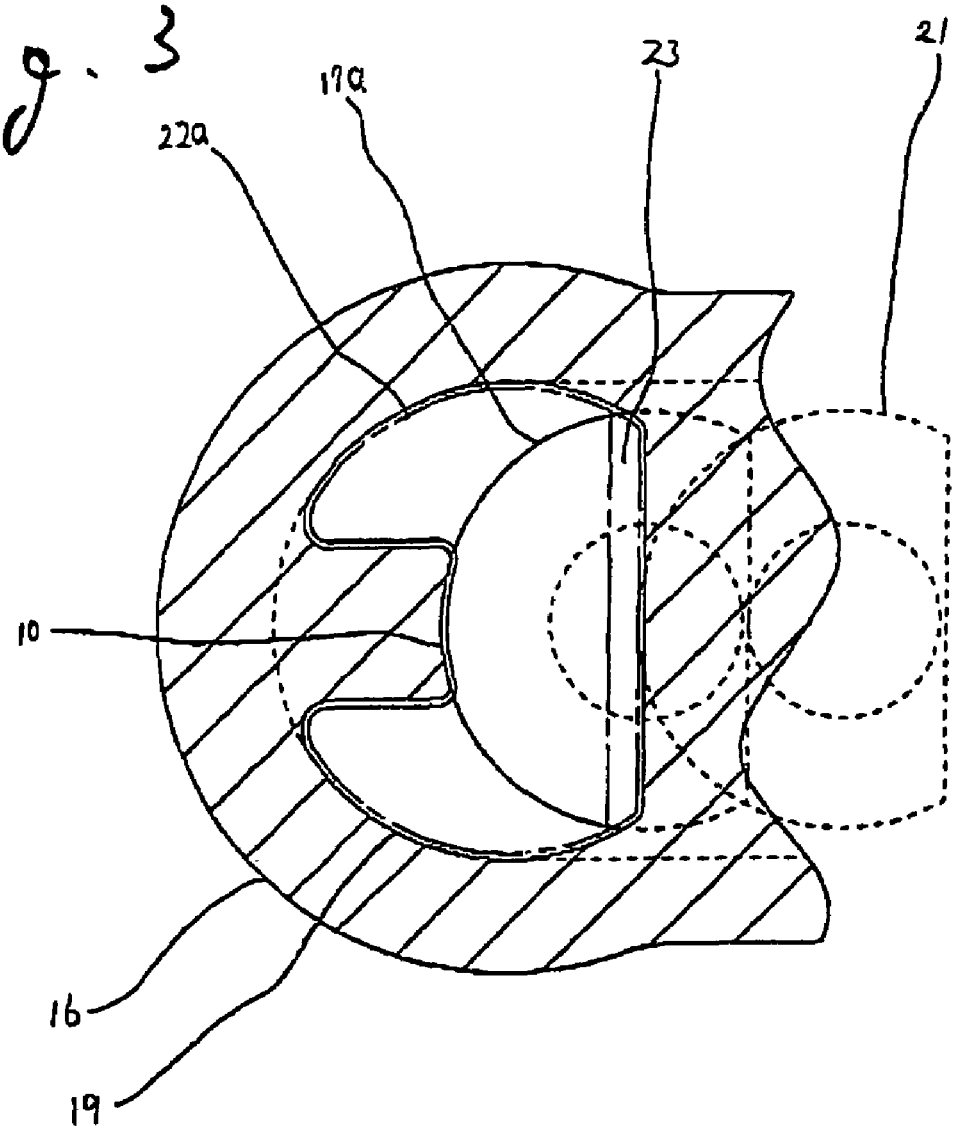
FIG. 3 is a sectional view taken along the line A—A in FIG. 2.
Figure 4:
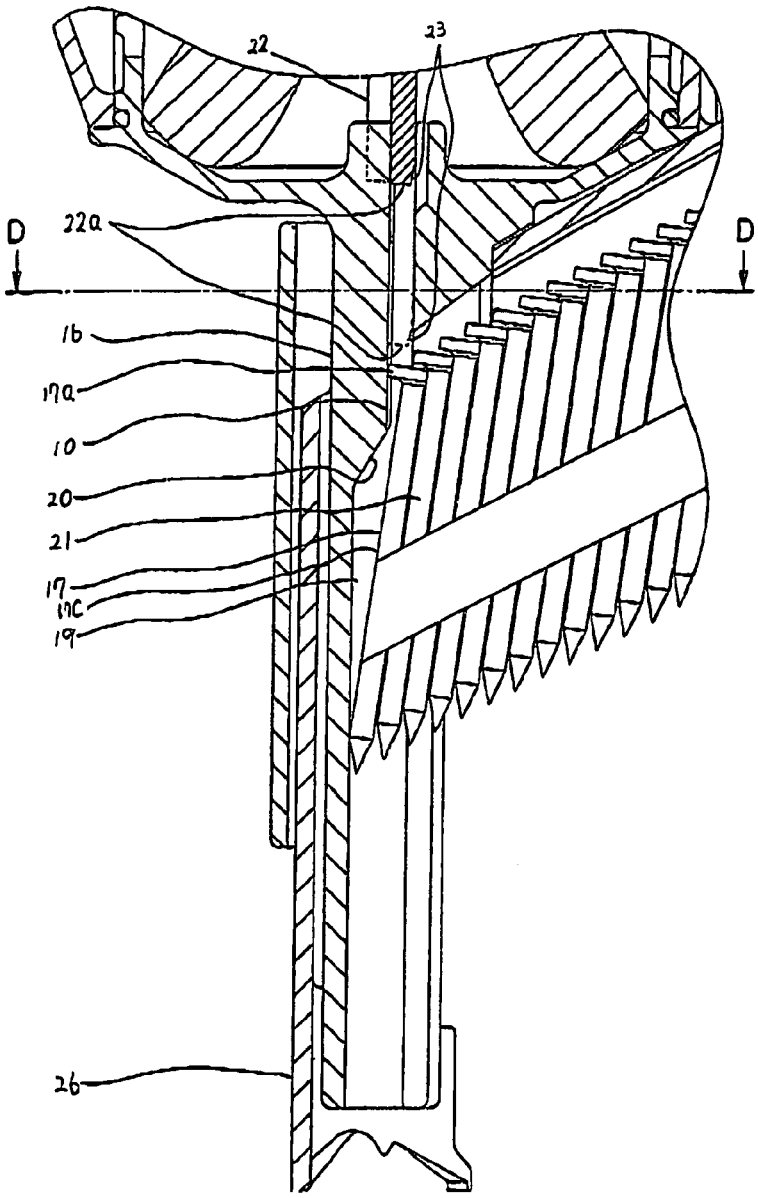
FIG. 4 is a sectioned side elevation showing a principal portion of one embodiment in which a nail of a minimum diameter within the scope of the specifications is struck by the fastener driving tool according to the present invention.
Figure 5:
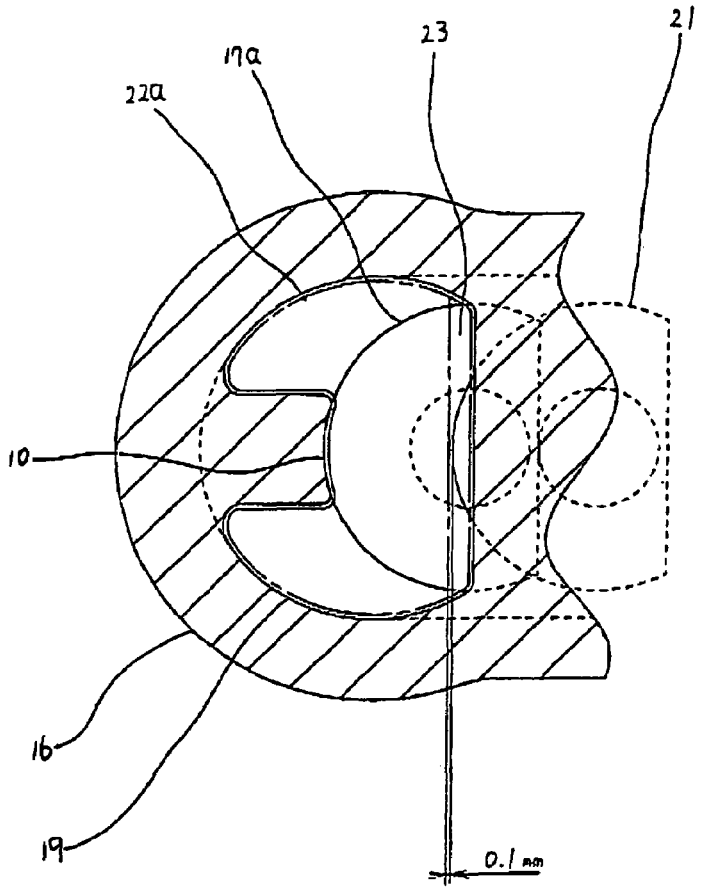
FIG. 5 is a sectional view taken along the line D—D in FIG. 4 showing the condition of a worn guide surface.
Figure 6:
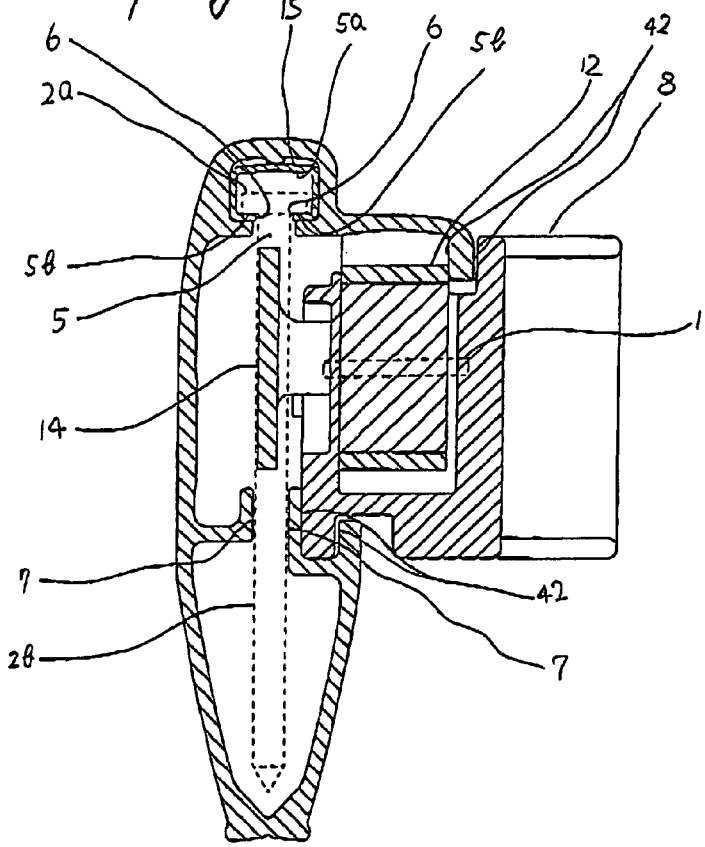
FIG. 6 is a sectional view taken along the line B—B showing a principal portion of a magazine employable in the present invention.
Figure 7:
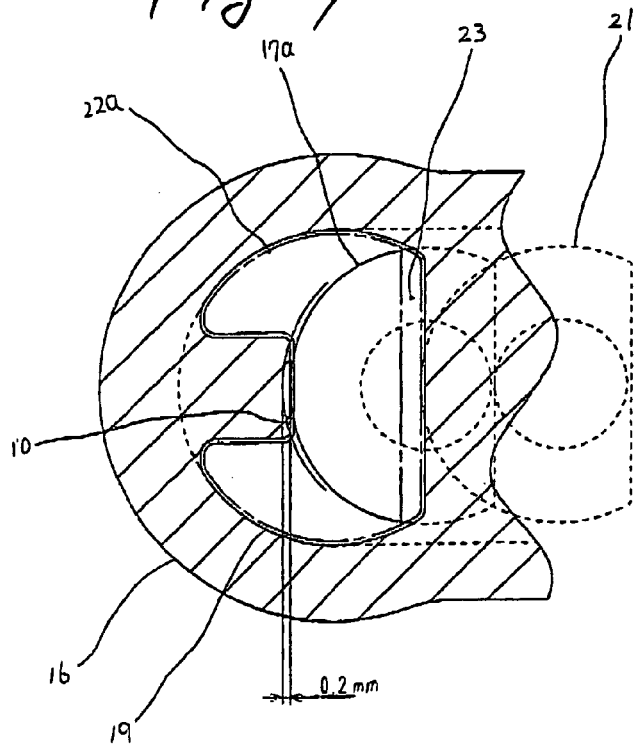
FIG. 7 is a drawing corresponding to the sectional view taken along the line A—A of FIG. 2, showing the nose with a nail of a maximum diameter within the scope of the specifications struck into an object.
Figure 8:
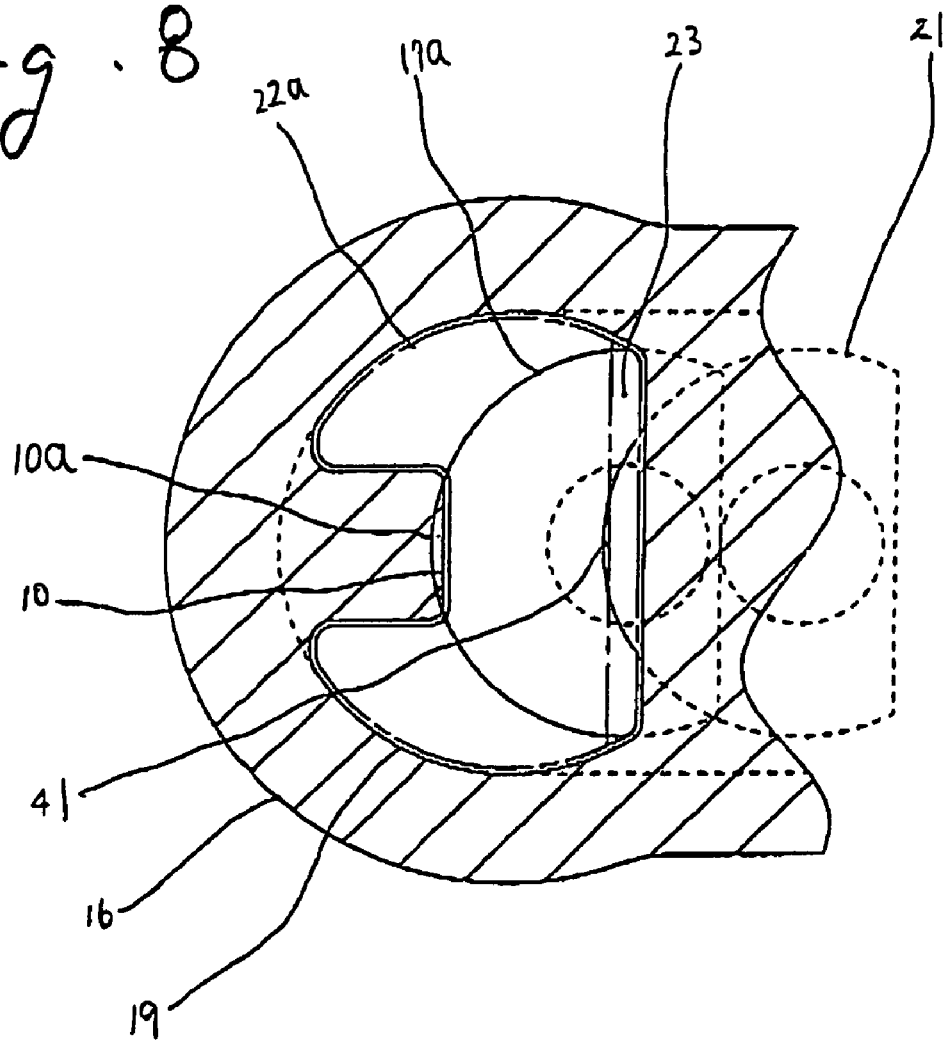
FIG. 8 is a drawing corresponding to the sectional view taken along the line D—D of FIG. 4, showing the nose with a nail of a minimum diameter within the scope of the specifications struck into an object.
Figure 9:
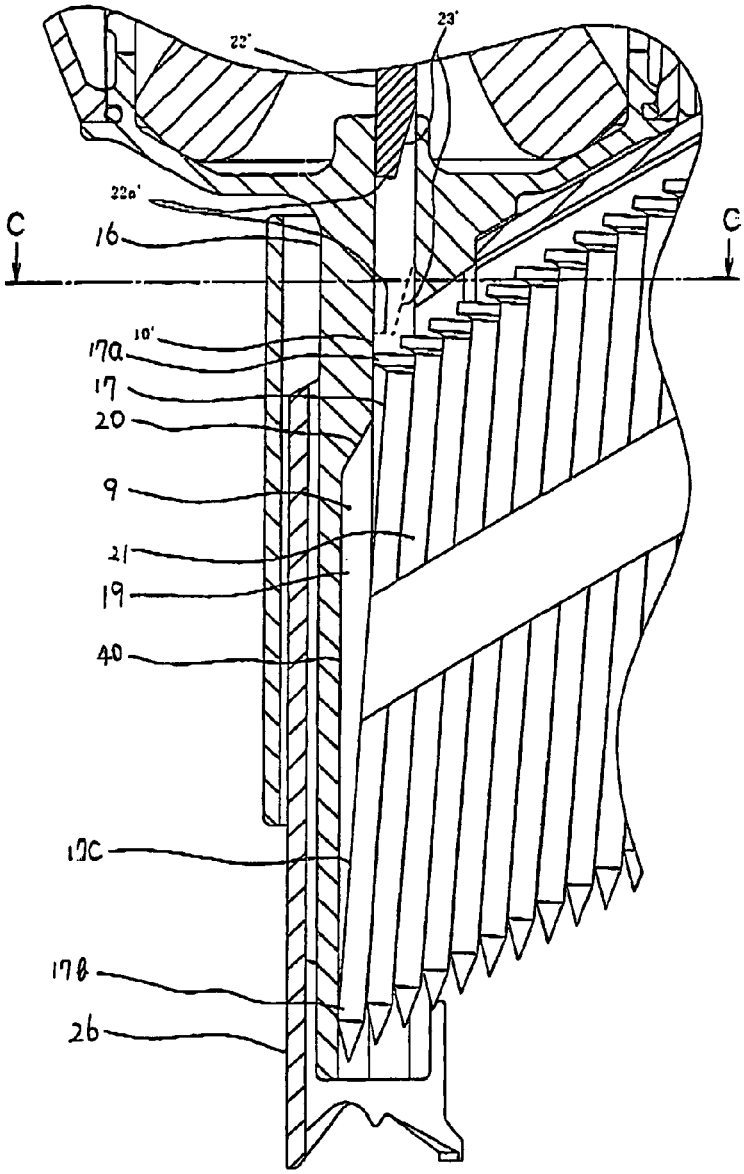
FIG. 9 is a sectioned side elevation corresponding to FIG. 2, showing another example of the nose with a nail of a maximum diameter within the scope of the specifications struck into an object.
Figure 10:
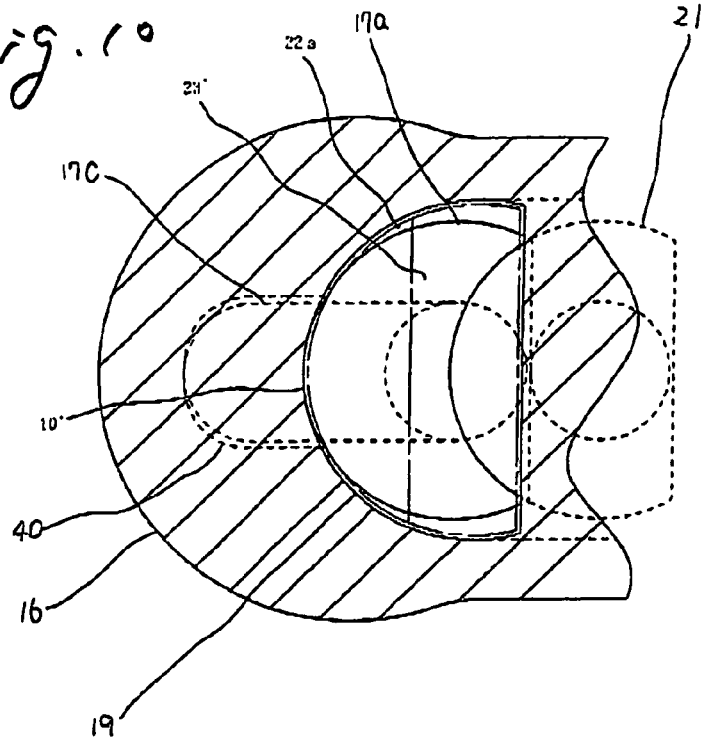
FIG. 10 is a sectional view taken along the line C—C in FIG. 9 showing the striking of a nail of a maximum diameter within the scope of the specifications.
Figure 11:
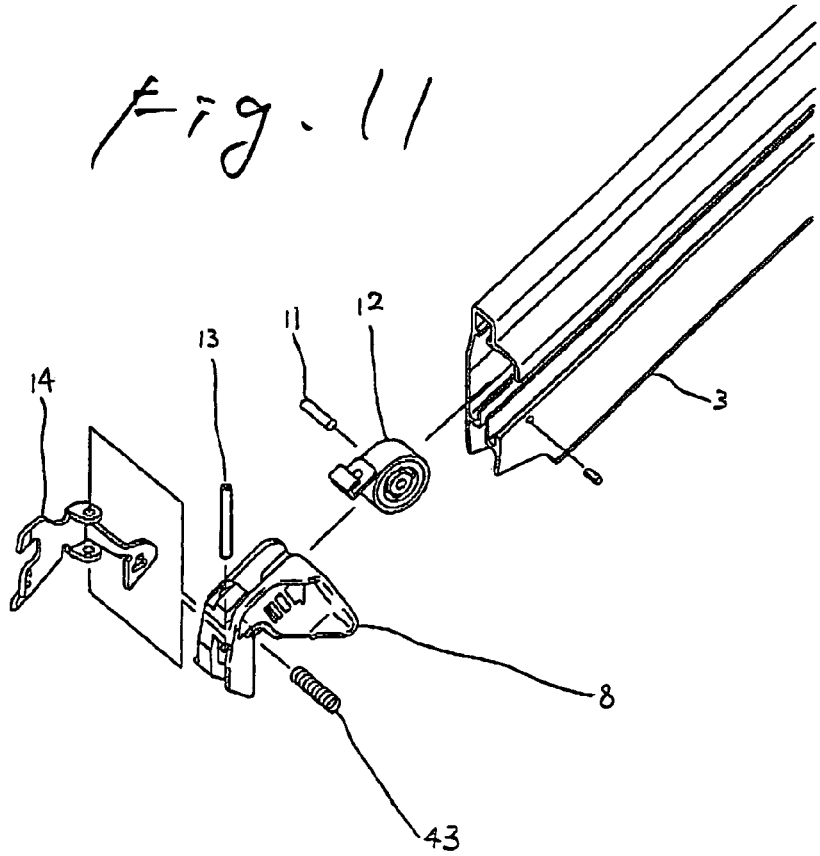
FIG. 11 is a perspective view showing one example of a nail feeding mechanism in the magazine.

The areas of the free end surfaces 22*a* of the driver blade 22 are not different from those of the corresponding portions of the related art structure of FIG. 7 and FIG. 8, so that the durability of the driver blade can be maintained.

To be concrete, in this mode of embodiment, the diameter and width of the guide surface 10 are 7.1 mm and 2.6 mm respectively, the maximum diameter within the scope of the specification of the nail head 7.1 mm which is equal to the diameter of the guide surface 10, and the thickness of the nail head 17*a* 1.4 mm, so that the contact surface area becomes about 3.6 $mm^2$.

A minimum diameter within the scope of the specification of the nail head 17*a* is 6.8 mm, and the nail head contacts the guide surface 10 locally in an initial stage. When the guide surface 10 wears 0.01 mm, the diameter of the guide surface becomes equal to that of the nail head. Even when the guide surface wears 0.01 mm, the superposition 41 does not occur since there is a distance of 0.1 mm between the second nail 21 and the free end surfaces 22*a* of the driver blade 22, so that the second nail 21 is not struck by the free end surface 22*a*.

When the diameter of the nail head 2 and that of the contact surface 10 in the related art structure of FIG. 7 to FIG. 8 become equal to each other, the contact surface 10 wears 0.2 mm. Especially, in the nails of a minimum diameter within the scope of the specifications which has a small diameter, the second nail 21 advances to the exit port 19 as shown in FIG. 8, and the free end surface 22*a* and the second nail 21 collide with each other.

What is claimed is:

1. A nailing machine comprising:

a driver blade adapted to drive a nail, from a plurality of nails being joined to one another, into an object in order;

a nose having a slot portion to receive the nail and adapted to guide the driver blade;

a nail feeding mechanism to press the nails toward the slot portion of the nose, said nose having a projection extending outwardly from an inner surface of the slot portion toward the nail feeding mechanism, wherein the projection has a curved surface adapted to guide a circular head portion of a first nail struck out into an exit hole of the nose so that a second nail is not exposed to the exit hole, and wherein a curvature of the curved surface of the projection is formed to be same as that of the circular head portion of the nail.

2. The nailing machine according to claim 1, wherein a diameter of a guide surface of the projection is set equal to a maximum diameter of the head portion of the nail to be used.

3. The nailing machine according to claim 1, wherein an outer circumferential surface of the head portion of the nail contacts a substantial portion of the guide surface, so that a surface pressure applied to the guide surface becomes small, thereby enabling local wear on the guide surface to decrease, and durability of the guide surface to improved.

4. The nailing machine according to claim 2, wherein the outer circumferential surface of the head portion of the nail contacts a substantial portion of the guide surface, so that a surface pressure applied to the guide surface becomes small, thereby enabling local wear on the guide surface to decrease, and durability of the guide surface to improved.

5. The nailing machine according to claim 1, wherein the diameter of the guide surface is 7.1 mm and a width of the guide surface is 2.6 mm.

6. The nailing machine according to claim 2, wherein the diameter of the guide surface is 7.1 mm and a width of the guide surface is 2.6 mm.

7. The nailing machine according to claim 1, wherein a cross-section of the driver blade is substantially a semicircular shape.

8. The nailing machine according to claim 2, wherein a cross-section of the driver blade is substantially a semicircular shape.

9. The nailing machine according to claim 1, wherein free end surfaces of the driver blade are provided with chamfered portions so that the free end surfaces do not strike the second nail.

10. The nailing machine according to claim 2, wherein free end surfaces of the driver blade are provided with chamfered portions so that the free end surfaces do not strike the second nail.

11. nailing machine comprising:

a driver blade adapted to drive a nail, from a plurality of nails being joined to one another, into an object in order;

a nose having a slot portion to receive the nail and adapted to guide the driver blade;

a nail feeding mechanism to press the nails toward the slot portion of the nose, said nose having a projection extending outwardly from an inner surface of the slot portion toward the nail feeding mechanism, wherein the projection has a curved surface adapted to guide a circular head portion of a first nail struck out into an exist hole of the nose so that a second nail is not exposed to the exit hole, and wherein a guide surface of the projection is formed to have a curved shape identical with that of head portion of the nail, so that a diameter of the guide surface of the projection is set to a maximum diameter of the head portion of the nail to prevent a second nail from being struck by the driver blade.

12. The nailing machine according to claim 11, wherein a diameter of the guide surface of the projection is set equal to a maximum diameter of the head portion of the nail to be used.

13. The nailing machine according to claim 11, wherein an outer circumferential surface of the head portion of the nail contacts a substantial portion of the guide surface, so that a surface pressure applied to the guide surface becomes small, thereby enabling local wear on the guide surface to decrease, and durability of the guide surface to improved.

14. The nailing machine according to claim 12, wherein an outer circumferential surface of the head portion of the nail contacts a substantial portion of the guide surface, so that a surface pressure applied to the guide surface becomes small, thereby enabling local wear on the guide surface to decrease, and durability of the guide surface to improved.

15. The nailing machine according to claim 11, wherein the diameter of the guide surface is 7.1 mm and a width of the guide surface is 2.6 mm.

16. The nailing machine according to claim 12, wherein the diameter of the guide surface is 7.1 mm and a width of the guide surface is 2.6 mm.

17. The nailing machine according to claim 11, wherein a cross-section of the driver blade is substantially a semicircular shape.

18. The nailing machine according to claim 12, wherein a cross-section of the driver blade is substantially a semicircular shape.

19. The nailing machine according to claim 11, wherein free end surfaces of the driver blade are provided with chamfered portions so that the free end surfaces do not strike the second nail.

20. The nailing machine according to claim 12, wherein free end surfaces of the driver blade are provided with chamfered portions so that the free end surfaces do not strike the second nail.

* * * * *